US005884575A

United States Patent [19]

Talasimov

[11] Patent Number: 5,884,575

[45] Date of Patent: Mar. 23, 1999

[54] NAUTICAL BALANCE SYSTEM

[76] Inventor: Mario Talasimov, Av 18 de Julio 2294 Piso 13, 11200 Montevideo, Uruguay

[21] Appl. No.: 891,807

[22] Filed: Jul. 14, 1997

[51] Int. Cl.[6] ..... B63H 39/02

[52] U.S. Cl. ..... 114/39.1; 114/124; 114/363

[58] Field of Search ..... 114/39.1, 39.2, 114/124, 363

[56] References Cited

U.S. PATENT DOCUMENTS

| | | | |
|---|---|---|---|
| 521,388 | 6/1894 | Pool | 114/124 |
| 545,095 | 8/1895 | Redmond | 114/124 |
| 2,238,464 | 4/1941 | Fletcher . | |
| 4,539,926 | 9/1985 | Boffer . | |
| 4,852,507 | 8/1989 | Ryon et al. . | |
| 4,936,236 | 6/1990 | Sinden . | |
| 4,986,202 | 1/1991 | Mourgne et al. . | |

FOREIGN PATENT DOCUMENTS

| | | |
|---|---|---|
| 2464180 | 4/1981 | France . |
| 2195297 | 4/1988 | United Kingdom . |

*Primary Examiner*—Sherman Basinger
*Attorney, Agent, or Firm*—Richard C. Litman

[57] ABSTRACT

A nautical balance system for installation on small sailboats. The system improves the ability of a helmsman to counter the heeling force of the wind on the sails by providing a swinging seat supported by semicircular rail for supporting the weight of the helmsman outboard of the sailboat. The system enables the helmsman to easily use his weight to limit the heel of the sailboat. The system is independent of mast location and provides for tacking under a low boom.

16 Claims, 4 Drawing Sheets

NAUTICAL BALANCE SYSTEM

BACKGROUND OF THE INVENTION

1. Field of the Invention

The present invention relates to a balance system for installation on small sailboats which improves the ability of a helmsman to counter the heeling force of the wind on the sails. More particularly, the system enables the helmsman to easily use his weight to limit the heel of the sailboat.

2. Description of the Related Art

It has long been recognized that the position of the weight of the crew is critical to the performance of small sailboats. For sailboats that are double or single handed, the position of the weight of the helmsman is also important. On such small boats, the weight of the crew and helmsman is the major force used to counter the heeling force of the wind on the sails. Thus, devices that assist the helmsman or crew in shifting and maintaining body weight near or beyond the sides of the boat enable the boat to be sailed upright and efficiently level.

One such a device is disclosed in the U.S. Pat. No. 2,238,464 issued Apr. 15, 1941, to W. G. Fletcher. Fletcher discloses a convertible sailing vessel including a swinging arm. The swinging arm is pivotally supported by a main frame at a single location. The arm permits a crew member, but not the helmsman, to use body weight to balance the vessel.

U.S. Pat. No. 4,539,926, issued Sep. 10, 1985, to J. Boffer, discloses a sailboat having an outrigger which is supported solely by a sleeve which encircles the foot of the mast. The helmsman is supported on a seat on the outrigger. A relatively high cut sail is attached to the mast to allow the helmsman to pass under the sail when tacking.

U.S. Pat. No. 4,852,507, issued Aug. 1, 1989, to R. C. Ryon et al., discloses a sail craft including a semicircular seat, foot rail and back stop used by a helmsman in maneuvering his body as a counterweight.

U.S. Pat. No. 4,936,236, issued Jun. 26, 1990, to F. W. Sinden, discloses a moment balancing rig for a sailboat. The rotatable rig includes a boom for supporting the helmsman. The boom is attached to a mast that is in turn attached to the hull of the boat.

U.S. Pat. No. 4,986,202, issued Jan. 22, 1991, to P. Mourgne et al. and British Patent Application No. 2195297 published Apr. 7, 1988, show a fixed transverse rail extending between lateral hulls of a trimaran. A seat slides along the rail to permit crew members to counterbalance the boat.

French Application No. 79 11824 discloses a catamaran including a saddle permitting a helmsman seated in the saddle to balance the boat by pivoting the saddle. The saddle is mounted on a short arm that requires insignificant support.

None of the above inventions and patents, taken either singularly or in combination, is seen to describe the instant invention as claimed. Thus, a nautical balance system solving the concerns encountered when attempting to counterbalance the heel of a small sailboat is desired.

SUMMARY OF THE INVENTION

When sailing a small sailboat, particularly upwind, it is desirable for a helmsman to hike his body weight as far as possible beyond the windward rail to counter the heeling force of the wind on the sails. The present nautical balance system is a device that assists the helmsman in moving his body weight to counteract this heeling force. The system also assists the helmsman in maintaining his body weight beyond the windward rail for extended periods of time as the boat is sailed upwind.

The nautical balance system includes an outrigger that supports the helmsman. The outrigger pivots about a bearing on the centerline of the boat. The outrigger is supported by the pivot bearing and by a semicircular rail assembly fastened to the deck of the sailboat. The outrigger is slidably supported by the rail assembly as the outrigger pivots about the bearing. Rollers are included to promote the movement of the outrigger along the rail. The additional support of the rail assembly limits the force borne by the pivot bearing and the deck supporting the bearing.

The outrigger includes a seat for the helmsman. When seated on the outrigger the helmsman is able to stabilize himself and the outrigger by placing his feet on the rail assembly. The helmsman also controls the angular position of the outrigger with his feet placed on the rail assembly. To ensure that the helmsman can manipulate and stabilize himself the outrigger rides along a rail that is raised above the deck. The rail also extends beyond the limit of rotation of the outrigger so that the helmsman may always put both feet on the rail while straddling the outrigger. The seat is adjustable along the outrigger to fit the length of the helmsman's legs.

The pivot bearing is located in a position independent of the location of the mast thereby allowing the weight of the helmsman to be located at the optimal position for performance of the sailboat. A pivot bearing located aft of the mast also permits the helmsman to swing behind the boom when tacking. This permits the boom to be positioned relatively lower on the mast and, therefore, the sail to be larger and more efficient.

Accordingly, it is a principal object of the invention to provide a nautical balance system on a sailboat to assist a helmsman using his body weight to counterbalance the heeling force of the wind on the sails.

It is a further object of the invention to provide a nautical balance system having a outrigger supported at multiple points for holding a helmsman over the windward rail of a sailboat with minimal stress transmitted to the deck.

Another object of the invention is to provide a rail by which the helmsman can steady himself and manipulate the position of the outrigger with his feet on the rail.

Still a further object of the invention is to provide a seat for the helmsman which swings aft of a low boom when the boat is tacked.

It is an object of the invention to provide improved elements and arrangements thereof in a nautical balance system for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
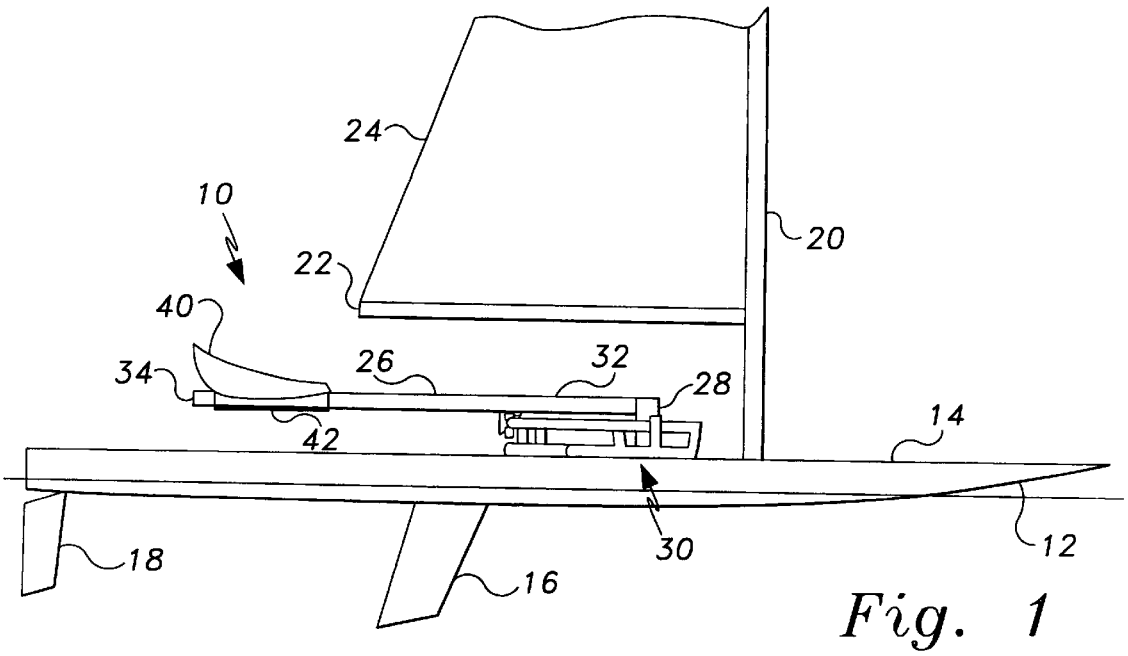
FIG. 1 is a side view of a sailboat including the present nautical balance system.
Figure 2:
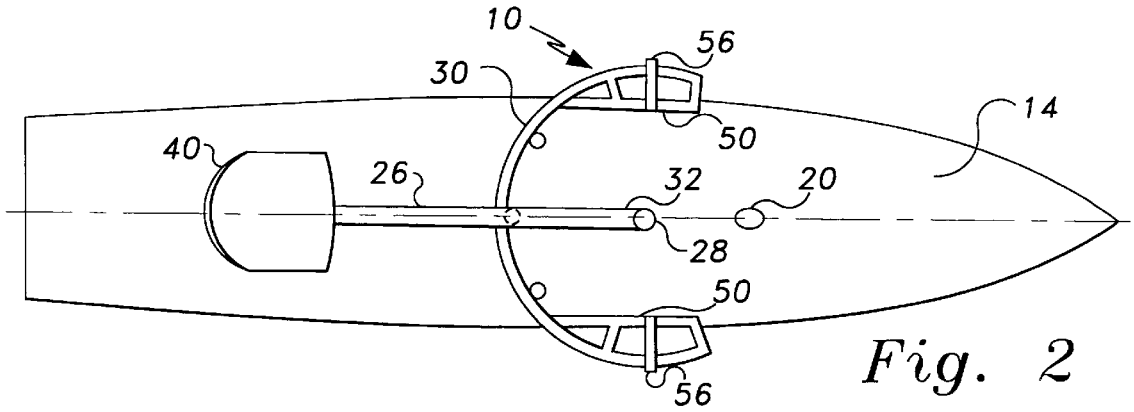
FIG. 2 is a plan view of the sailboat shown in FIG. 1.

The present nautical balance system 10 installed on a small sailboat is shown in FIGS. 1 and 2. The main structural assembly of the sailboat includes a hull 12 and a deck 14. A keel or centerboard 16 and a rudder 18 are attached to the underwater surface of hull 12. On the longitudinal center line of the hull 12 and deck 14 is a mast 20 that supports a boom 22 and a sail 24.

Figure 4:
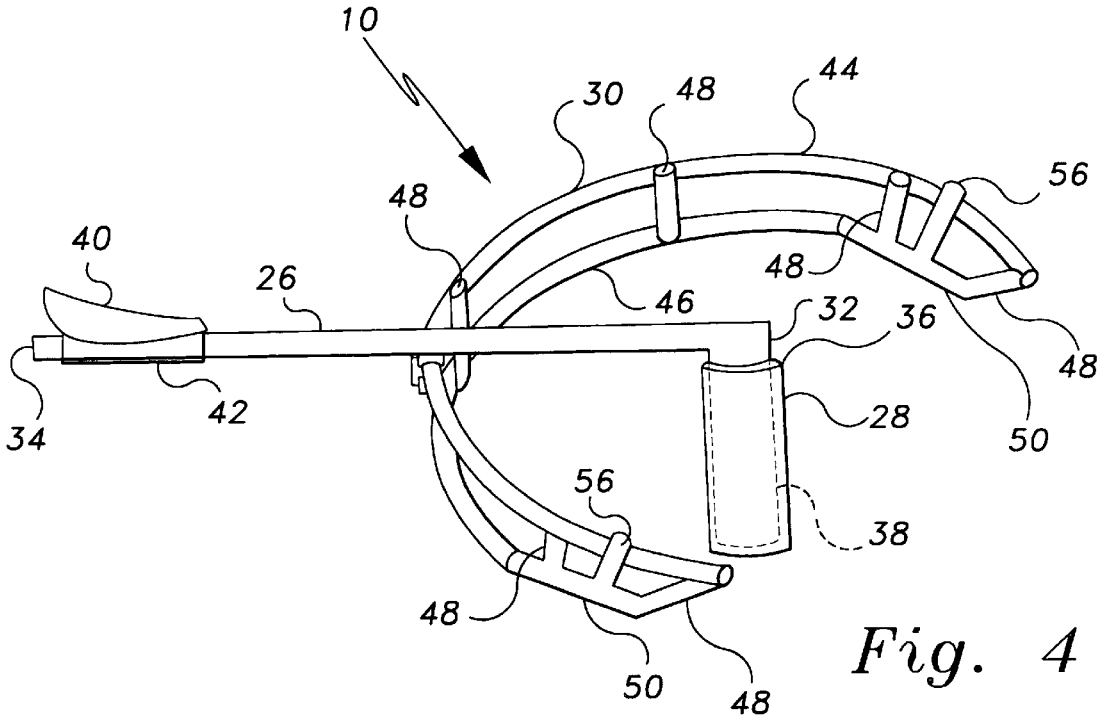
FIG. 4 is a perspective view of the present nautical balance system.

The nautical balance system 10 as shown in FIG. 4 includes an outrigger 26, a pivot bearing 28, and a rail assembly 30. Outrigger 26 is oriented primarily parallel to deck 14 and thus perpendicular to mast 20. Outrigger 26 includes a pivot end 32 and an outboard end 34. Pivot end 32 is pivotally supported by pivot bearing 28. Rail assembly 30 slidably supports outrigger 26 at a point between pivot end 32 and outboard end 34.

As shown in FIG. 4, pivot bearing 28 includes a sleeve 36. Sleeve 36 extends perpendicularly from deck 14 on the longitudinal centerline of hull 12 and deck 14. Pivot end 32 of outrigger 26 includes a perpendicular tube 38 that fits within sleeve 36. Tube 38 is free to rotate within sleeve 36 and outrigger 26 may therefore swing or rotate about pivot bearing 28.

Proximate outboard end 34 of outrigger 26 is seat 40. Seat 40 provides means for supporting a weight, specifically the body weight of the helmsman, outboard of deck 14. Seat 40 is movably attached on outrigger 26 with bracket 42.

Rail assembly 30 is fastened to deck 14 and further supports outrigger 26. Rail assembly 30 is essentially semicircular in shape to support outrigger 26 as it rotates or swings about pivot bearing 28. The semicircular shape has a constant radius of curvature but does not necessarily extend through precisely one half of a circle. Rail assembly 30 has an upper support rail 44 and a lower connection rail 46. Upper support rail 44 is supported above deck 14 by a plurality of generally vertical rail supports 48. Rail supports 48 are connected to lower connection rail 46, which is in turn fastened to deck 14. In the preferred embodiment upper rail 44 is supported about 4–5 inches above the deck and rail assembly 30 has a radius of about 1 foot 3¾ inches.

It is upper rail 44 that comes in contact with and directly supports outrigger 26. Therefore, it is the upper rail 44 that must have a constant radius of curvature and must be centered about pivot bearing 28 such that a single point along outrigger 26 contacts rail assembly 30 as outrigger swings or rotates about pivot bearing 28. As can be seen in FIG. 2, lower connection rail 46 need not be precisely semicircular, but may include flattened sections 50. To provide the most effective support it is important that upper rail 44 have a large diameter. A diameter larger than the beam of the boat can be supported by lower rail 46 with flattened sections 50 that extend along the sides of deck 14.

Figure 3:
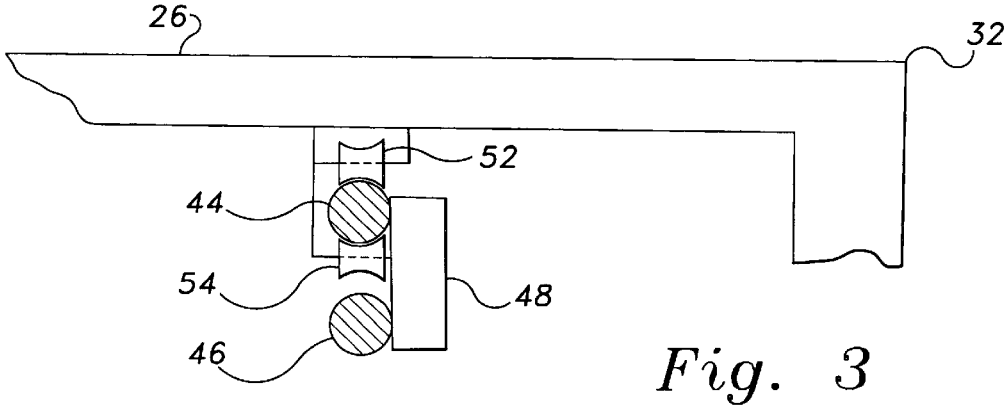
FIG. 3 is an enlarged, partial side view of the present nautical balance system.

As shown in FIG. 3, outrigger 26 includes an upper roller 52 disposed above upper rail 44 to assist the outrigger 26 in sliding along upper rail 44. Outrigger 26 also includes a lower roller 54 disposed below upper rail 44. Lower roller 54 steadies outrigger 26 by ensuring that outrigger 26 is kept in continuous contact with rail assembly 30 during any motion of the sailboat that tends to raise outrigger 26. To permit both upper roller 52 and lower roller 54 to slide unobstructed along upper rail 44, rail supports 48 are attached to the inside edge of upper rail 44.

Rail assembly 30 also includes stops 56 to limit the rotation or swing of outrigger 26. Stops 56 extend above upper rail 44 to engage outrigger 26 upon reaching the point of maximum rotation. In the preferred embodiment, stops 56 are positioned to stop outrigger 26 when it has rotated 90° from the centerline of hull 12 and deck 14. The outrigger 26 in a position 90° from the centerline produces the maximum heel resisting moment by holding the weight of the helmsman the maximum distance from the center of the hull. Rail assembly 30 extends beyond stops 56 to provide a resting surface for the helmsman's foot when the outrigger 26 engages stop 56. Thus rail assembly 30 is not precisely a semicircle but extends through an arc greater than 180°, with stops 56 disposed a substantial distance from the ends of upper rail 44.

In use seat 40 is positioned such that the helmsman's legs comfortably reach rail assembly 30 when the helmsman is seated in seat 40. The helmsman sits in seat 40 and controls the sailboat from this position. Controls, such as the tiller and the sheets, are led to the helmsman seated in seat 40. The helmsman controls the rotation or swing of outrigger 26 with his feet placed on rail assembly 30. As the force of the wind heels the sailboat, the helmsman swings himself outboard on outrigger 26 thereby using his weight to counteract the heeling force. The outrigger 26 easily supports the weight of the helmsman as the helmsman moves his weight outboard to counter the heeling force of the wind on the sails. The outrigger permits the helmsman to sail the boat from a steady secure position seated in seat 40 with his feet firmly placed on rail assembly 30. The helmsman can easily swing his weight inboard and outboard on outrigger 26 to maintain the most efficient sailing configuration. The helmsman weight is supported by outrigger 26 at all times permitting the helmsman to keep his weight outboard for extended periods of time.

Figure 5:
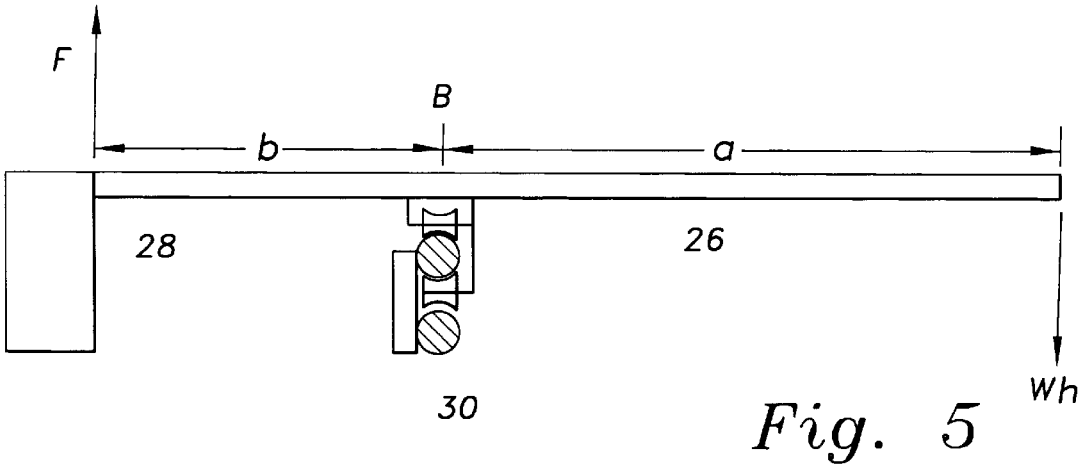
FIG. 5 is a diagrammatic view representing the forces on the present nautical balance system.

Adjustably supporting the weight of the helmsman with nautical balance system 10 described above has a number of significant advantages. As shown in FIG. 5, the use of rail assembly 30 to support outrigger 26 significantly reduces the forces transmitted to structural members of deck 14. Assuming a helmsman with a weight of 176 lbs ($W_h$) supported 2.7 ft (a) from rail assembly 30 and an upper rail with a radius of 1.3 ft (b). The force F of pivot bearing 28 will can be calculated as follows:

$$F = \frac{W_h(a)}{b}$$

$$F = \frac{176\text{lbs}(2.7\text{ft})}{1.3\text{ft}}$$

$$F = 365\text{lbs}$$

The force on rail assembly 30 at point B is:

$$F+W_h=365lbs+176lbs=541lbs$$

This force is distributed around the deck by the rail assembly 30. These loads can be easily supported by the structure of deck 14. Without rail assembly 30 the deck under pivot bearing 28 must support the entire weight of outrigger 26 and the helmsman. Also the deck supporting the pivot must resist the moment of:

$$W_h(a+b)=176lbs(2.7ft+1.3ft)=704ftlbs$$

This moment cannot be resisted by most deck structures.

Figure 6:
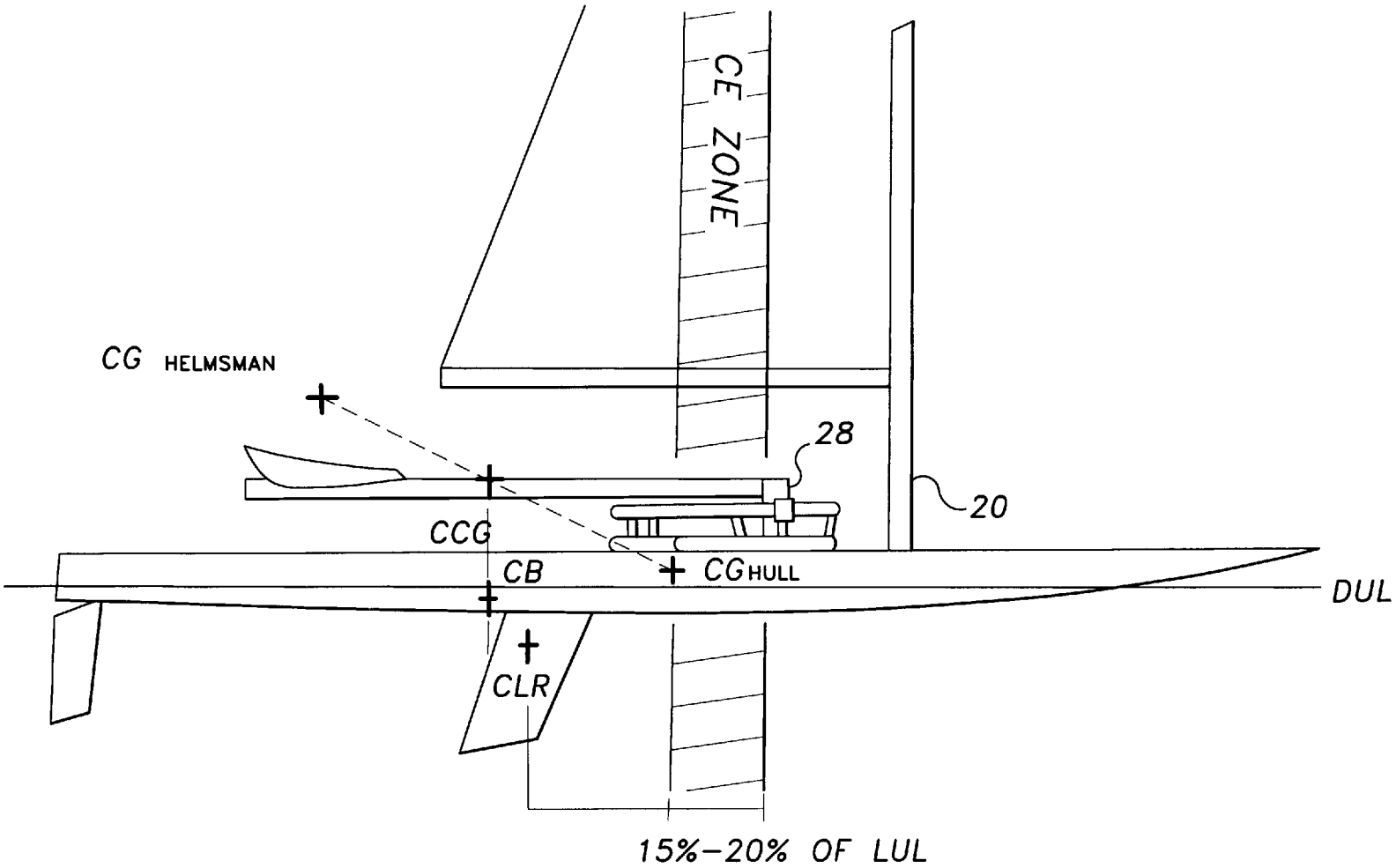
FIG. 6 is a diagrammatic view representing the forces on a sailboat including the present nautical balance system.

As shown in FIG. 6 it is important that the pivot bearing 28 be located independently from mast 20. While sailing in a straight line, the position of the center of lateral resistance (CLR) of the hull in the water must correspond to the center effort (CE) of the wind on the sails. Due to the effect of the waves produced along the hull of a moving sailboat and the effect of the shape of the sails, the CE and CLR continuously change. To design a balanced boat, the center of the sail plan is typically placed forward cf the static lateral center of the underwater surface of the hull by 15 to 20 percent of the length of the load water line (LWL) as shown in FIG. 6. Also, the center of gravity (CG) of the sailboat must correspond with the center of buoyancy (CB) of the hull to keep the trim and heel of the boat correct. For small sailboats the weight of the helmsman has a significant effect on the center of gravity. Thus, the combined center of gravity (CCG) is the combination of the centers of gravity of the helmsman and the hull. Using the nautical balance system, the helmsman's weight is positioned to produce a CCG corresponding to the CB of the hull. Outrigger 26 does not pivot about the mast, because to do so would require the mast location to be dependent on the CCG rather than on the efficient placement of the CE. If CE is displaced, thereby destroying the relationship between the CE and the CLR, the rudder must be turned to keep the sailboat sailing in a straight line. This excessive rudder displacement causes unwanted excessive drag, which slows the sailboat.

Figure 7:
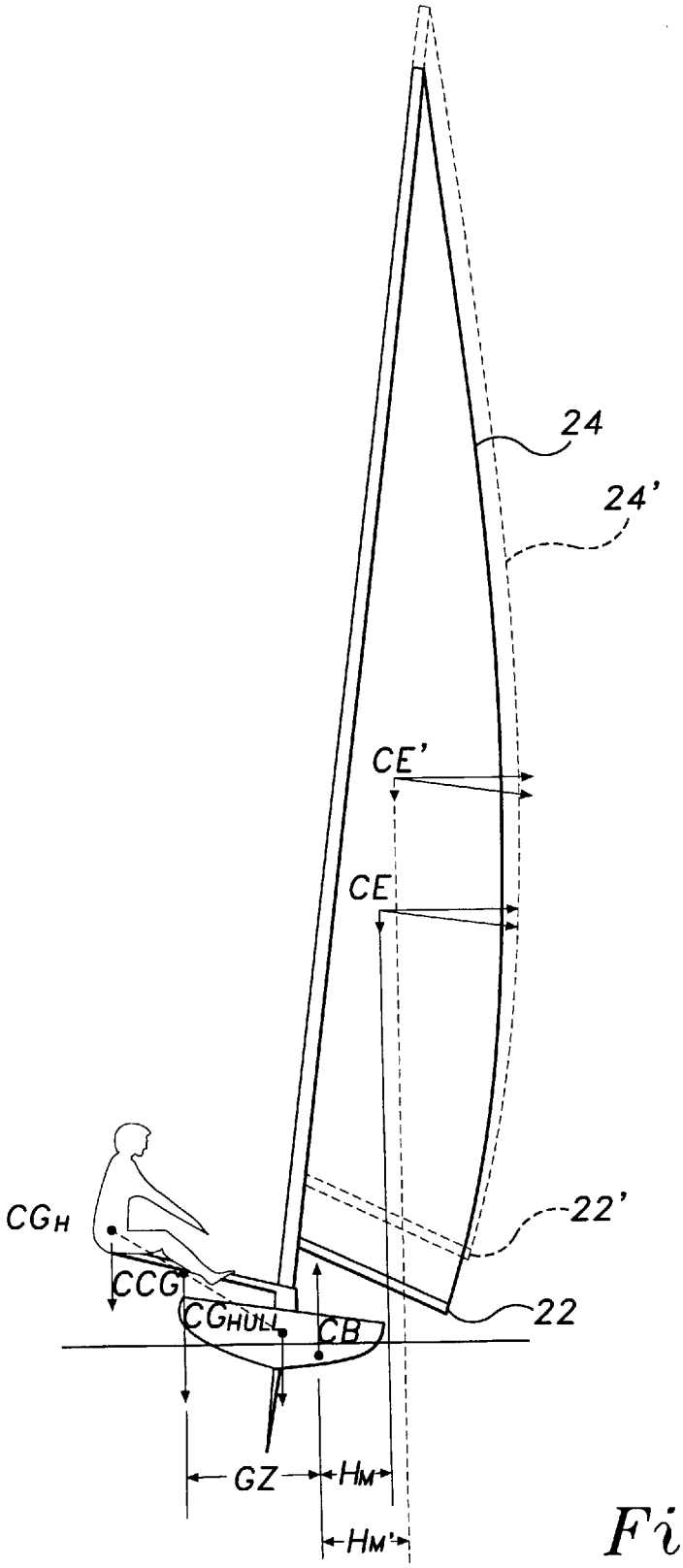
FIG. 7 is a diagrammatic view representing the righting forces on a sailboat using the present nautical balance system.

Another significant advantage of nautical balance system 10 is the ability to use a low boom. As the sailboat is tacked through the wind on a traditional small sailboat, the helmsman shifts his weight from one side of the sailboat to the other by ducking under the boom. The booms of traditional sailboats must therefore be located high enough to accommodate the helmsman. With the nautical balance system 10 the helmsman does not duck under the boom 22, but rather swings behind boom 22 on seat 40. This is possible, as shown in FIG. 1, since seat 40 is aft of the end of boom 12 when the boom and outrigger are both centered along the centerline. The advantage of a low boom is illustrated in FIG. 7. The sail 24 having a low boom 22 is shown in solid lines. A traditional sail 24' having a high boom 22' is shown in dashed lines. The center of effort CE of sail 24 is lower than would be the center of effort CE' of a traditional sail 24'. The traditional sail thus has a greater heeling moment arm $H_m'$. The heeling moment is countered by the displacement GZ of the center of gravity (CCG) from the center of buoyancy (CB). This displacement GZ or the weight of the helmsman must be increased if $H_m$ is increased to $H_m'$. A lower boom thus allows a lighter helmsman to carry a larger sail while countering the heeling force of the wind on the sail.

It is to be understood that the present invention is not limited to the embodiment described above, but encompasses any and all embodiments within the scope of the following claims.

I claim:

1. A nautical balance system comprising:

an outrigger having a pivot end and an outboard end;

a pivot bearing supporting the pivot end of said outrigger, said outrigger rotatable about said pivot bearing;

a rail assembly supporting said outrigger between the pivot end and the outboard end, said rail assembly including a rail having two ends; and support means for supporting a weight, said support means connected to said outrigger proximate the outboard end;

said outrigger includes:

a first roller disposed above said rail for supporting said outrigger on said rail, said first roller permitting said outrigger to slide along said rail; and a second roller disposed below said rail for maintaining said outrigger proximate, said rail.

2. The nautical balance system as defined in claim 1 wherein said support means comprises a seat for supporting a helmsman.

3. The nautical balance system as defined in claim 1 wherein said support means is disposed at a distance from said pivot end and said outrigger includes adjustment means for adjusting the distance from said pivot end to said support means.

4. The nautical balance system as defined in claim 1 wherein said rail assembly further includes a pair of stops for limiting rotation of said outrigger about said pivot bearing, one of said stops disposed a substantial distance from each one of the ends of said rail.

5. The nautical balance system as defined in claim 1 wherein said rail assembly further includes a plurality of rail supports depending from said rail for supporting said rail above a surface.

6. The nautical balance system as defined in claim 5 wherein said rail assembly further includes a lower connection rail attached to each of said rail supports, said lower connection rail for fastening to a supporting surface.

7. A sailboat comprising:

a hull and deck structure including a deck and having a longitudinal centerline;

a pivot bearing attached to said hull and deck structure;

an outrigger having a pivot end and an outboard end, the pivot end supported by said pivot bearing, said outrigger rotatable about said pivot bearing in a plane substantially parallel to said deck;

a generally semicircular rail assembly extending across substantially the entire deck and supporting said outrigger between the pivot end and the outboard end, said outrigger slidable along said rail assembly, said rail assembly attached to said hull and deck structure; and support means for supporting a weight, said support means connected to said outrigger proximate the outboard end.

8. The sailboat as defined in claim 7 wherein said pivot bearing is attached to said hull and deck structure on the centerline.

9. The sailboat as defined in claim 7 further comprising a mast for supporting at least one sail, said mast attached to said hull and deck structure, said pivot bearing attached to said hull and deck structure independently from said mast.

10. The sailboat as defined in claim 9 wherein said outrigger rotates about said pivot bearing in a plane substantially perpendicular to said mast.

11. The sailboat according to claim 7 wherein said support means comprises a seat for supporting a helmsman.

12. The sailboat according to claim 11 further comprising:

a mast attached to said hull and deck structure; and a boom attached to said mast; wherein said seat is aft of said boom when both said outrigger arid said boom are parallel to said centerline.

13. The sailboat according to claim 11 wherein said rail assembly includes a rail supported above said hull and deck structure, said rail supporting said outrigger said rail having two ends, whereby a helmsman seated in said seat is able to place his feet on said rail for stability and to control the rotation of said outrigger about said pivot bearing.

14. The sailboat according to claim 11 wherein said rail assembly includes a pair of stops for limiting rotation of said outrigger said stops disposed a substantial distance from the ends of said rail, whereby upon engagement of said outrigger with one of said stops the helmsman is able to place feet on said rail on both sides of said outrigger.

15. The sailboat according to claims 11 further including adjustment means for moving said seat along said outrigger.

16. A sailboat comprising:

a deck covering a hull to form an floating assembly having a longitudinal centerline;

a mast fastened to said deck on the longitudinal centerline, said mast for supporting at least one sail;

a boom attached to said mast;

a pivot bearing attached to said deck on the centerline at a location independent of said mast;

a rail assembly including, a upper support rail raised above said deck, said support rail having two ends, a lower connection rail fastened to said deck, a plurality of rail supports extending between said support rail and said connection rail, and a pair of stops fastened to said support rail a substantial distance from the ends of said support rail, said rail assembly having a generally semicircular shape centered about said pivot bearing and extending across said deck;

an outrigger having a pivot end and an outboard end, the pivot end supported by said pivot bearing, said outrigger including a roller assembly enabling said outrigger to slide along said upper support rail of said rail assembly, said roller assembly including, an upper roller disposed above said support rail for supporting said outrigger on said support rail, and a lower roller disposed below said support rail for maintaining said outrigger proximate said rail assembly;

an adjustable seat attached to said outrigger proximate the outboard end, said seat movable along said outrigger, said seat located aft of said boom when both said boom and said outrigger are aligned along the centerline.

* * * * *